US006357155B1

(12) United States Patent
Amadini

(10) Patent No.: US 6,357,155 B1
(45) Date of Patent: Mar. 19, 2002

(54) LOCKING MECHANISM FOR PISTOL

(76) Inventor: Sandro Amadini, Via 10 Giornate 82, Gardonne Val Trompia (IT), 25063

( * ) Notice: Subject to any disclaimer, the term of this patent is extended or adjusted under 35 U.S.C. 154(b) by 0 days.

(21) Appl. No.: 09/527,356

(22) Filed: Mar. 17, 2000

(51) Int. Cl.[7] ..... F41A 17/02
(52) U.S. Cl. ..... 42/70.11; 42/70.08
(58) Field of Search ..... 42/70.08, 70.11

(56) References Cited

U.S. PATENT DOCUMENTS 5,491,918 A * 2/1996 Elmstedt ..... 42/70.11
5,913,666 A * 6/1999 Perkins ..... 42/70.11

FOREIGN PATENT DOCUMENTS

CH 169078 * 7/1934 ..... 42/70.08

* cited by examiner

*Primary Examiner*—Stephen M. Johnson
(74) *Attorney, Agent, or Firm*—J. Sanchelima; A. Bordas

(57) ABSTRACT

A locking mechanism that can be used on pistols. The locking device primarily comprises a spacer sleeve and a slide cover keyed plate. The locking mechanism is controlled by a key, giving the authorized user the ability to set the pistol in a "fire" or "locked" mode. The locking mechanism is utilized as a means to prevent the movement of a pistol's firing pin assembly when activated by the trigger mechanism. The present invention is primarily utilized with semi-automatic pistols that have an enclosed striker assembly.

7 Claims, 2 Drawing Sheets

LOCKING MECHANISM FOR PISTOL

BACKGROUND OF THE INVENTION

1. Field of the Invention

The present invention relates to a locking mechanism for weapons, and more particularly, to a locking mechanism for pistols.

2. Description of the Related Art

Weapons and firearms are very dangerous. Every year many people are accidentally injured and killed when unauthorized users fire them, specially minors. Presently, pistols are manufactured without a built-in ability to place them in a "fire" or "locked" mode utilizing a key. There is a need for a practical and inexpensive assembly that can be incorporated into pistols without major structural changes to reduce the possibilities of unauthorized users from utilizing pistols.

There are no similar locking mechanisms to the best of applicant's knowledge, that are built-in in the pistols and utilize a key.

SUMMARY OF THE INVENTION

It is one of the main objects of the present invention to provide a locking mechanism for pistols that is utilized to lock a pistol's firing mechanism, reducing the possibilities of injury by unauthorized users.

It is still another object of the present invention to provide a key to set the pistol in a "fire" or "locked" mode.

It is another object of this invention to provide a locking mechanism for pistols that includes a locking device and a slide cover keyed plate.

It is another object of this invention to provide a locking mechanism for pistols in which the locking mechanism is utilized as a means to prevent the movement of a pistol's firing pin assembly when activated by the trigger mechanism.

It is still another object of the present invention to provide a locking mechanism utilized with semi-automatic pistols that have an enclosed striker assembly.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
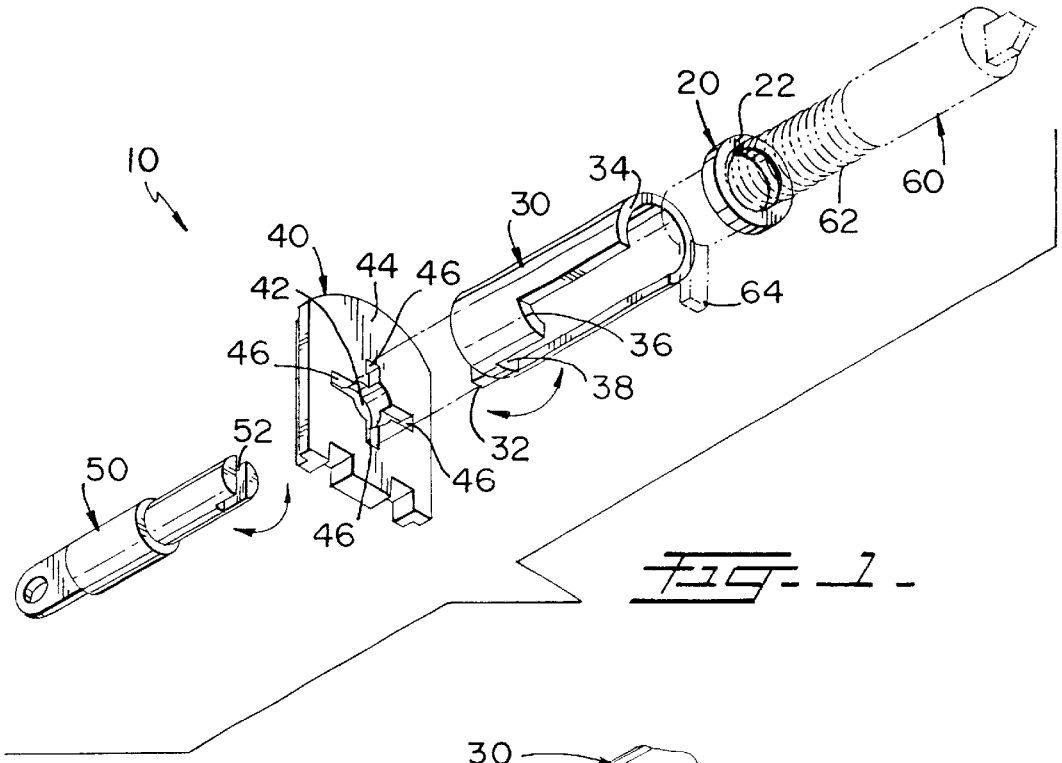
FIG. 1 represents an exploded view of the locking mechanism with the firing pin assembly shown in phantom.
Figure 1A:
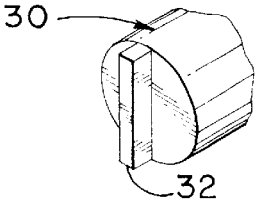
FIG. 1*a* shows an isometric view of the rear side of the spacer sleeve assembly.

Referring now to the drawings, where the present invention is generally referred to with numeral 10, it can be observed that it basically includes bushing 20, cylindrical spacer sleeve assembly 30, keyed plate assembly 40, and key 50.

As seen in FIG. 1, bushing 20 slidably journals onto firing pin assembly 60 between one end of firing pin spring 62 and firing pin leg 64. Bushing 20 has front face 22 and rear face 24 (shown in FIG. 2). Bushing 20 is manufactured from a durable material such as stainless steel, or a material of similar characteristics. Cylindrical spacer sleeve assembly 30 has a longitudinal stepped cut-out. Front edge 34 defines one end of sleeve assembly 30. Central stepped notch edge 36 is positioned at a parallel and spaced apart relationship with respect to edge 34. Rear stepped edge 38 receives firing pin leg 64. Cylindrical spacer sleeve assembly 30 is manufactured from a durable material such as stainless steel, or a material of similar characteristics. Keyed plate assembly 40 has interior face 44 and exterior face 48. Interior face 44 contains at least two radially extending interior face notches 46 to receive spacer sleeve locking cam 32. Radially extending interior face notches 46 may vary in angular difference in respect to each other, with the preferred angle being 90 degrees. Key 50 has a predetermined fixed end such as key notch 52 or the equivalent, that cooperatively receives spacer sleeve locking cam 32 of rear exterior surface 39.

Figure 2:
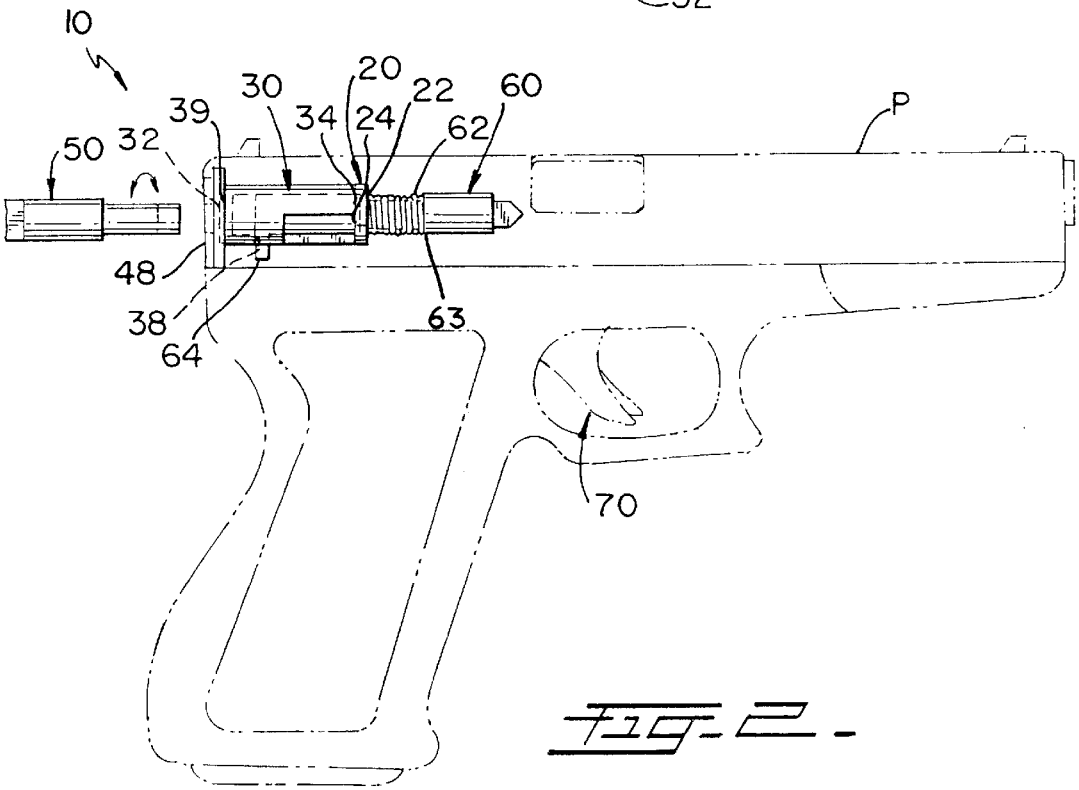
FIG. 2 shows an elevational view of a pistol in phantom and the present invention with the key.

As seen in FIG. 2, pistol P is in the firing mode. Firing pin assembly 60 includes firing pin spring 62, stopper surface 63, bushing 20, and firing pin leg 64. Bushing 20 has rear face 24, of which a portion abuts front edge 34 of spacer sleeve 30. Front face 22 is in contact with firing spring 62 and rear face 24 is in contact with front edge 34. Due to the force applied by firing pin spring 62 against stopper surface 63, firing pin leg 64 approaches rear stepped edge 38.

Figure 3:
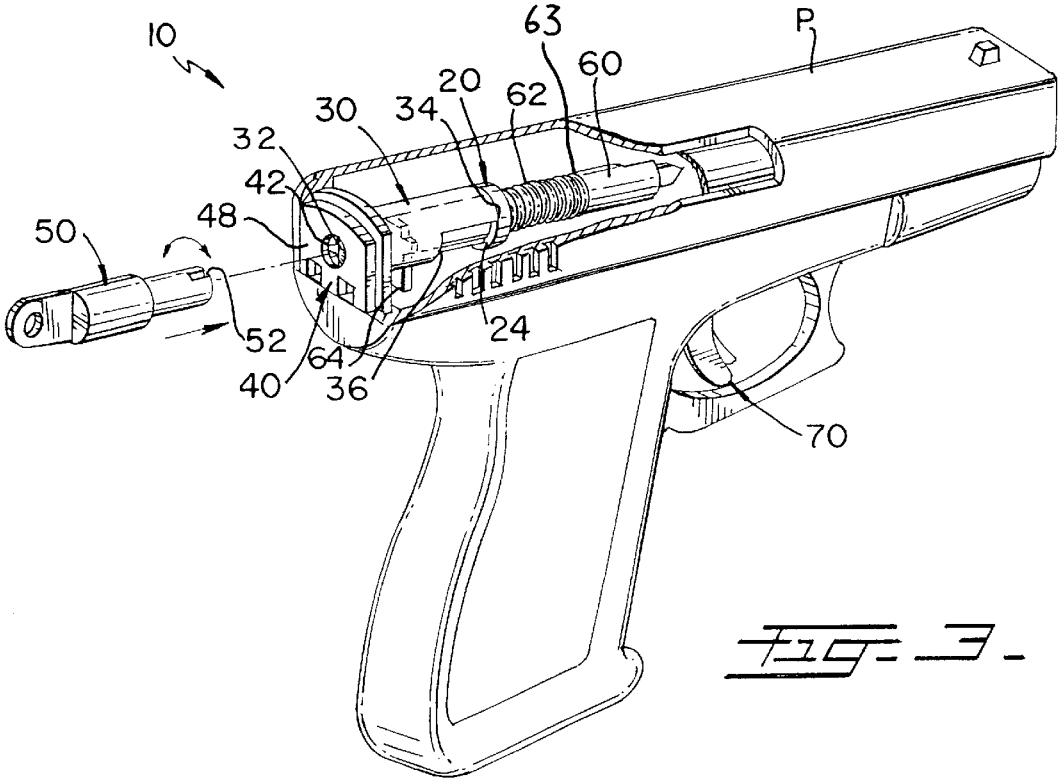
FIG. 3 illustrates an isometric view of a pistol showing the present invention in the fire position.

As best seen in FIG. 3, pistol P is in the firing mode. An authorized user utilizes key 50 by inserting it into key hole 42 of exterior face 48. Key notch 52 is shaped to receive spacer sleeve locking cam 32 (shown in FIG. 1). A user exerts an inwardly force to overcome the force of firing pin spring 62, then turns key 50, thereby rotating cylindrical spacer sleeve assembly 30 to the firing mode position. Firing pin leg 64 approaches rear stepped edge 38 (shown in FIG. 1), thereby allowing the movement of the pistol's firing pin assembly 60 when activated by trigger mechanism 70. Pistol P may be of any variety of semi-automatic pistols that have an enclosed striker assembly. Such a pistol may be a "GLOCK", "FNM-49", "SIGMA", or "KAHR", without limitation to these specific brands.

Figure 4:
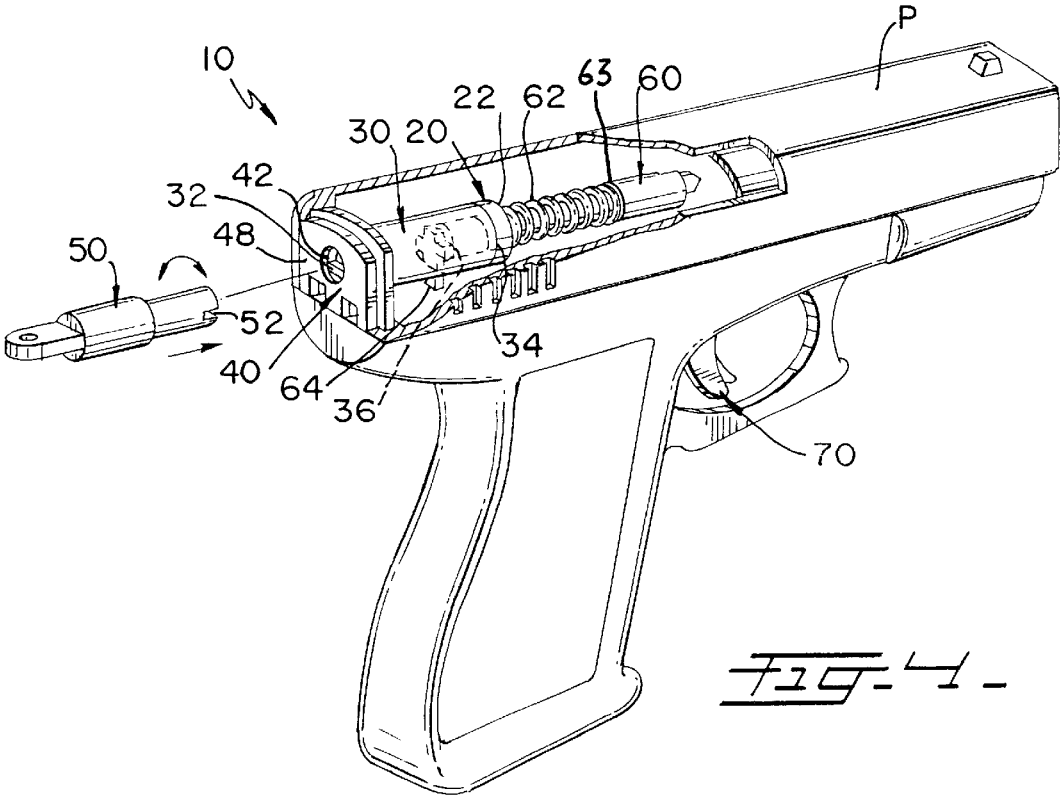
FIG. 4 illustrates an isometric view of a pistol showing the present invention in lock position.

As seen in FIG. 4, pistol P is in the locked mode. An authorized user utilizes key 50, inserting it into key hole 42 of keyed plate 40. Key notch 52 is shaped to fit onto spacer sleeve locking cam 32. The user exerts force to overcome the force of firing pin spring 62, then turns key 50, thereby rotating cylindrical spacer sleeve assembly 30 to locked mode position wherefore firing pin leg 64 rests upon cylindrical spacer sleeve central stepped notch edge 36, thereby preventing the movement of pistol's firing pin assembly 60 when activated by trigger mechanism 70.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A locking mechanism having an enclosed striker assembly, comprising:

A) a firing pin assembly having a shaft with first and second ends, said first end having a leg extending radially outwardly a first predetermined distance and said second end including a firing pin, said firing pin assembly further includes a stopper surface on said shaft at a second predetermined distance from said second end and a spring member receiving said shaft therethrough, and said spring member includes third and fourth ends, said third end coacts against said stopper surface and said fourth end includes a bushing rigidly mounted thereon that in turn coacts with said leg keeping said spring member biased against said stopper surface and said leg;

B) a spacer sleeve assembly having fifth and sixth ends and a longitudinal stepped notch extending from said fifth end towards said sixth end a predetermined distance without reaching said sixth end, said stepped notch includes an end edge closest to said sixth end and a stepped edge located at a third predetermined distance from said end edge, said fifth end having cooperative dimensions to coact with said bushing and selectively causing said spring member to compress, and said sixth end including a protrusion with a unique shape axially mounted thereon;

C) a keyed plate assembly having inner and outer walls and a central through opening, said inner wall including at least two cutouts with mating cooperative characteristics to receive said protrusion in at least two angular positions of said spacer sleeve assembly; and D) means for rotating said spacer sleeve assembly through said through opening so that said leg is selectively brought in alignment with said stepped edge thereby restricting the travel of said shaft and in alignment with said end edge having unobstructed travel that permits the operation of a pistol.

2. The locking mechanism having an enclosed striker assembly set forth in claim 1, wherein said means includes a key, insertable through said central through opening of said key plate to said protrusion so that a user exerting an inwardly and rotational force to overcome the force of said spring member, and rotating said spacer sleeve assembly selectively from a locked mode position to an unlocked mode position and vice-a-versa.

3. A locking mechanism having an enclosed striker assembly, comprising:

A) a firing pin assembly having a bushing between a firing pin spring and a firing pin leg;

B) a modified spacer sleeve assembly having a front edge, a central stepped notch edge, and rear stepped edge that receives said firing pin assembly, said front edge abuts said bushing, said firing pin leg rests against said central stepped notch edge when said pistol is in locked mode, and said firing pin leg approaches said rear stepped edge when said pistol is in firing mode, said modified spacer assembly having a protrusion from a rear exterior surface of said modified spacer sleeve assembly;

C) a keyed plate assembly with an interior face and an exterior face, said interior face containing at least two radially extending notches to complement said protrusion from said rear exterior surface, said keyed plate assembly contains an opening therethrough; and D) means to place said pistol in said locked mode thereby reducing the possibilities of injury in the event of an unauthorized user utilizing a pistol.

4. The locking mechanism having an enclosed striker assembly set forth in claim 3, wherein said means includes preventing the movement of said pistol's firing pin assembly when activated by a trigger mechanism.

5. The locking mechanism having an enclosed striker assembly set forth in claim 4, wherein said means includes rotating said modified spacer sleeve assembly thereby setting the locking mechanism in said locked or firing mode.

6. The locking mechanism having an enclosed striker assembly set forth in claim 5, wherein said means includes an authorized user utilizing a key, inserting said key into said opening therethrough of said key plate to fit onto said protrusion from said rear exterior surface and exerting an inwardly force to overcome the force of said firing pin spring, turning said key, thereby rotating said modified spacer sleeve assembly to said locked mode position wherefore said firing pin leg rests upon said modified spacer sleeve central stepped notch edge, thereby preventing the movement of said pistol's firing pin assembly when activated by the trigger mechanism.

7. The locking mechanism having an enclosed striker assembly set forth in claim 5, wherein said means includes an authorized user utilizing a key, inserting said key into said opening therethrough of said key plate to fit onto said protrusion from said rear exterior surface and exerting an inwardly force to overcome the force of said firing pin spring, turning said key, thereby rotating said modified spacer sleeve assembly to said firing mode position wherefore said firing pin leg approaches said rear stepped edge of said modified spacer sleeve assembly.

* * * * *